US008100277B1

(12) United States Patent
Bush et al.

(10) Patent No.: US 8,100,277 B1
(45) Date of Patent: Jan. 24, 2012

(54) PEELABLE SEAL FOR AN OPENING IN A CONTAINER NECK

(75) Inventors: Randall G. Bush, Evansville, IN (US); William J. Shankland, Evansville, IN (US); Louis J. Marsella, Reno, NV (US)

(73) Assignees: Rexam Closures and Containers Inc., Evansville, IN (US); Momar Industries, LLC, Northbrook, IL (US)

( * ) Notice: Subject to any disclaimer, the term of this patent is extended or adjusted under 35 U.S.C. 154(b) by 1404 days.

(21) Appl. No.: 11/612,540

(22) Filed: Dec. 19, 2006

Related U.S. Application Data

(63) Continuation-in-part of application No. 11/181,576, filed on Jul. 14, 2005, now abandoned.

(51) Int. Cl.
*B65D 41/00* (2006.01)

(52) U.S. Cl. ..... 215/305; 215/350; 215/349

(58) Field of Classification Search ..... 215/232, 215/252, 349, 305
See application file for complete search history.

(56) References Cited

U.S. PATENT DOCUMENTS

| | | | | | |
|---|---|---|---|---|---|
| 946,138 | A | | 1/1910 | Kirkegaard | |
| 1,060,369 | A | * | 4/1913 | Schwenck | 215/305 |
| 1,127,357 | A | * | 2/1915 | Gavaza | 215/305 |
| 1,346,112 | A | | 7/1920 | Bruns | |
| 1,556,020 | A | | 10/1925 | Noll | |
| 1,715,882 | A | * | 6/1929 | Wygonik | 215/253 |
| 1,910,913 | A | | 5/1933 | Conner | |
| 1,916,977 | A | | 7/1933 | Gutmann | |
| 1,937,492 | A | | 11/1933 | Merolle | |
| 1,961,033 | A | | 5/1934 | Bicks | |
| 1,995,350 | A | | 3/1935 | Hoag | |
| 2,039,757 | A | | 5/1936 | Von Till | |
| 2,085,934 | A | | 7/1937 | Von Till | |
| 2,155,946 | A | | 4/1939 | Loetscher | |
| 2,156,258 | A | * | 5/1939 | Atwood | 215/253 |
| 2,188,946 | A | | 2/1940 | Gutmann | |
| 2,242,256 | A | | 5/1941 | McManus | |
| 2,312,513 | A | | 3/1943 | Wilson | |
| 2,620,939 | A | | 12/1952 | Weisgerber | |
| 2,643,021 | A | | 6/1953 | Freedman | |
| 2,670,869 | A | | 3/1954 | Martin | |
| 2,681,742 | A | | 6/1954 | Miller | |
| 2,686,606 | A | | 8/1954 | Froitzheim | |
| 2,686,607 | A | | 8/1954 | Zander | |
| 2,748,969 | A | | 6/1956 | Leary | |
| 2,904,837 | A | | 9/1959 | Crabbe | |
| 2,929,525 | A | | 3/1960 | Glover | |
| 2,950,833 | A | * | 8/1960 | Short | 215/235 |
| 3,143,364 | A | | 8/1964 | Klein | |

(Continued)

FOREIGN PATENT DOCUMENTS

| | | |
|---|---|---|
| CA | 2572379 | 12/2006 |

(Continued)

*Primary Examiner* — Anthony Stashick
*Assistant Examiner* — Christopher McKinley
(74) *Attorney, Agent, or Firm* — Barnes & Thornburg LLP

(57) ABSTRACT

A peelable seal having one or more layers for sealing containers by heat sealing may include a stiffening structure, a foil portion, and a sealant structure. The stiffening structure of the seal includes an outer periphery or overhanging portion which extends beyond the rim of a neck of a container thereby allowing the peelable seal to be loosened from the container by flicking the overhanging portion of the peelable seal with a portion of the hand and without the need to pinch the seal.

37 Claims, 12 Drawing Sheets

U.S. PATENT DOCUMENTS

| | | | | | |
|---|---|---|---|---|---|
| 3,169,656 | A | | 2/1965 | Wieckmann | |
| 3,186,209 | A | | 6/1965 | Friedman | |
| 3,189,209 | A | | 6/1965 | Owens | |
| 3,200,982 | A | * | 8/1965 | Cormier | 215/253 |
| 3,224,617 | A | | 12/1965 | Hohl | |
| 3,245,857 | A | | 4/1966 | Rutledge | |
| 3,255,907 | A | | 6/1966 | Eddy | |
| 3,266,658 | A | | 8/1966 | Meissner | |
| 3,269,577 | A | * | 8/1966 | Stuart | 215/254 |
| 3,331,523 | A | | 7/1967 | Exton | |
| 3,360,149 | A | | 12/1967 | Roth | |
| 3,382,997 | A | * | 5/1968 | Tsuji | 215/253 |
| 3,501,042 | A | * | 3/1970 | Grumbles et al. | 215/232 |
| 3,527,372 | A | | 9/1970 | Manning | |
| 3,530,917 | A | | 9/1970 | Donovan | |
| 3,547,294 | A | | 12/1970 | Williams | |
| 3,612,325 | A | | 10/1971 | Williams | |
| 3,632,004 | A | * | 1/1972 | Grimes et al. | 215/232 |
| 3,788,510 | A | | 1/1974 | Collins | |
| 3,815,314 | A | | 6/1974 | Pollock et al. | |
| 3,823,182 | A | | 7/1974 | Nonaka et al. | |
| 3,845,525 | A | | 11/1974 | Gaylord | |
| 3,857,506 | A | * | 12/1974 | Hafele | 215/46 |
| 3,879,492 | A | | 4/1975 | Bontinick | |
| 3,910,410 | A | | 10/1975 | Shaw | |
| 3,917,100 | A | | 11/1975 | Dukess | |
| 3,923,179 | A | | 12/1975 | Choksi | |
| 3,923,182 | A | | 12/1975 | Choksi | |
| 3,923,183 | A | | 12/1975 | Choksi | |
| 3,923,184 | A | | 12/1975 | Choksi | |
| 3,923,185 | A | | 12/1975 | Choksi et al. | |
| 3,944,103 | A | | 3/1976 | Cros | |
| 3,973,719 | A | | 8/1976 | Johnson et al. | |
| 3,980,194 | A | | 9/1976 | Costa | |
| 4,007,848 | A | | 2/1977 | Snyder | |
| 4,009,793 | A | | 3/1977 | Minesinger et al. | |
| 4,013,188 | A | | 3/1977 | Ray | |
| 4,066,181 | A | | 1/1978 | Robinson et al. | |
| 4,076,152 | A | | 2/1978 | Mumford | |
| 4,091,949 | A | | 5/1978 | Fowles et al. | |
| 4,093,093 | A | | 6/1978 | Fowles et al. | |
| 4,109,815 | A | | 8/1978 | Collins, III | |
| 4,128,184 | A | | 12/1978 | Northup | |
| 4,151,924 | A | | 5/1979 | Jameson | |
| 4,181,232 | A | | 1/1980 | Bellamy et al. | |
| 4,204,604 | A | | 5/1980 | Morin et al. | |
| 4,207,990 | A | | 6/1980 | Weiler et al. | |
| 4,209,126 | A | | 6/1980 | Elias | |
| 4,266,687 | A | | 5/1981 | Cummings | |
| 4,275,817 | A | | 6/1981 | Patton | |
| 4,276,989 | A | | 7/1981 | Hicks | |
| 4,280,653 | A | | 7/1981 | Elias | |
| 4,358,919 | A | | 11/1982 | Hirota et al. | |
| 4,364,485 | A | * | 12/1982 | Knapp | 215/232 |
| 4,369,889 | A | | 1/1983 | Ostrowsky | |
| 4,378,894 | A | | 4/1983 | Willis et al. | |
| 4,381,840 | A | | 5/1983 | Ostrowsky | |
| 4,382,521 | A | | 5/1983 | Ostrowsky | |
| 4,392,579 | A | | 7/1983 | Uhlig et al. | |
| 4,423,821 | A | | 1/1984 | McIntosh | |
| 4,427,126 | A | | 1/1984 | Ostrowsky | |
| 4,430,288 | A | | 2/1984 | Bonis | |
| 4,434,904 | A | | 3/1984 | D'Amico et al. | |
| 4,457,440 | A | * | 7/1984 | Dukess | 215/347 |
| 4,473,163 | A | | 9/1984 | Geiger | |
| 4,493,427 | A | | 1/1985 | Wolkonsky | |
| 4,496,674 | A | | 1/1985 | Ehrhart et al. | |
| 4,501,371 | A | | 2/1985 | Smalley | |
| 4,523,689 | A | * | 6/1985 | Laub | 215/232 |
| 4,526,279 | A | | 7/1985 | Weiler et al. | |
| 4,527,705 | A | | 7/1985 | Prades | |
| 4,564,117 | A | | 1/1986 | Herbert | |
| 4,576,297 | A | * | 3/1986 | Larson | 215/250 |
| 4,583,665 | A | | 4/1986 | Barriac | |
| 4,588,099 | A | | 5/1986 | Diez | |
| 4,625,875 | A | | 12/1986 | Carr et al. | |
| 4,637,519 | A | | 1/1987 | Dutt et al. | |
| 4,638,913 | A | | 1/1987 | Howe, Jr. | |
| 4,643,330 | A | | 2/1987 | Kennedy | |
| 4,648,520 | A | | 3/1987 | Stull | |
| 4,651,886 | A | * | 3/1987 | Stull | 215/329 |
| 4,662,529 | A | | 5/1987 | Moore | |
| 4,668,458 | A | * | 5/1987 | Whitney | 264/249 |
| 4,674,642 | A | | 6/1987 | Towns et al. | |
| 4,674,643 | A | | 6/1987 | Wilde et al. | |
| 4,682,463 | A | | 7/1987 | Foldesi | |
| 4,683,016 | A | | 7/1987 | Dutt et al. | |
| 4,694,970 | A | | 9/1987 | Hayes | |
| 4,704,180 | A | | 11/1987 | Marsella et al. | |
| 4,705,188 | A | | 11/1987 | Rahn | |
| 4,706,835 | A | | 11/1987 | Kreiseder | |
| 4,709,815 | A | | 12/1987 | Price et al. | |
| 4,721,215 | A | | 1/1988 | Bertaud | |
| 4,722,447 | A | * | 2/1988 | Crisci | 215/232 |
| 4,723,685 | A | | 2/1988 | Fillmore et al. | |
| 4,729,926 | A | | 3/1988 | Koteles et al. | |
| 4,730,748 | A | | 3/1988 | Bane | |
| 4,738,370 | A | | 4/1988 | Urmston et al. | |
| 4,747,500 | A | | 5/1988 | Gach et al. | |
| 4,747,502 | A | | 5/1988 | Luenser | |
| 4,754,890 | A | | 7/1988 | Ullman et al. | |
| 4,754,892 | A | | 7/1988 | Retief | |
| 4,757,914 | A | | 7/1988 | Roth et al. | |
| 4,764,403 | A | | 8/1988 | Ajmera | |
| 4,778,698 | A | | 10/1988 | Ou-Yang | |
| 4,779,750 | A | | 10/1988 | Armstrong | |
| 4,782,968 | A | | 11/1988 | Hayes | |
| 4,793,504 | A | * | 12/1988 | Towns et al. | 215/250 |
| 4,801,037 | A | | 1/1989 | Hayashida et al. | |
| 4,807,745 | A | | 2/1989 | Langley et al. | |
| 4,807,770 | A | | 2/1989 | Barriac | |
| 4,809,858 | A | | 3/1989 | Ochs | |
| 4,810,541 | A | | 3/1989 | Newman et al. | |
| 4,815,617 | A | | 3/1989 | Cullum | |
| 4,818,577 | A | | 4/1989 | Ou-Yang | |
| 4,842,951 | A | | 6/1989 | Yamada et al. | |
| 4,846,359 | A | | 7/1989 | Baird et al. | |
| 4,875,594 | A | | 10/1989 | Ochs | |
| 4,879,147 | A | | 11/1989 | Newman et al. | |
| 4,881,649 | A | | 11/1989 | Hsu et al. | |
| 4,892,911 | A | | 1/1990 | Genske | |
| 4,893,718 | A | | 1/1990 | Delespaul et al. | |
| 4,894,266 | A | | 1/1990 | Bauer et al. | |
| 4,896,783 | A | | 1/1990 | Leoncavallo et al. | |
| 4,935,273 | A | | 6/1990 | Ou-Yang | |
| 4,951,829 | A | * | 8/1990 | Hsu | 215/253 |
| 4,981,229 | A | | 1/1991 | Lanham | |
| 4,981,230 | A | | 1/1991 | Marshall et al. | |
| 4,991,731 | A | | 2/1991 | Osip et al. | |
| 4,997,097 | A | | 3/1991 | Krautkramer | |
| 5,002,811 | A | | 3/1991 | Bauer et al. | |
| 5,006,384 | A | | 4/1991 | Genske | |
| 5,007,546 | A | | 4/1991 | Rose et al. | |
| 5,009,323 | A | | 4/1991 | Montgomery et al. | |
| 5,009,324 | A | | 4/1991 | Ochs | |
| 5,011,719 | A | | 4/1991 | Gehrke et al. | |
| 5,012,946 | A | * | 5/1991 | McCarthy | 220/258.2 |
| 5,023,121 | A | | 6/1991 | Pockat et al. | |
| 5,031,787 | A | | 7/1991 | Ochs | |
| 5,058,755 | A | | 10/1991 | Hayes | |
| 5,061,532 | A | | 10/1991 | Yamada | |
| 5,069,355 | A | | 12/1991 | Matuszak | |
| 5,071,686 | A | | 12/1991 | Genske et al. | |
| 5,078,290 | A | | 1/1992 | Ochs | |
| 5,092,469 | A | | 3/1992 | Takata et al. | |
| 5,093,164 | A | * | 3/1992 | Bauer et al. | 428/35.4 |
| 5,110,642 | A | | 5/1992 | Genske | |
| 5,120,787 | A | | 6/1992 | Drasner | |
| 5,121,845 | A | * | 6/1992 | Blanchard | 215/232 |
| 5,135,125 | A | | 8/1992 | Andel et al. | |
| 5,151,317 | A | | 9/1992 | Bothe | |
| 5,160,767 | A | | 11/1992 | Genske et al. | |
| 5,175,035 | A | | 12/1992 | Pinsolle et al. | |
| 5,176,271 | A | * | 1/1993 | Painchaud et al. | 215/261 |
| 5,178,293 | A | | 1/1993 | Suzuki et al. | |
| 5,197,618 | A | | 3/1993 | Goth | |
| 5,197,620 | A | | 3/1993 | Gregory | |

5,197,621 A 3/1993 Bartl et al.
5,246,126 A * 9/1993 Lewis, Jr. ..... 215/303
5,255,813 A 10/1993 Berggren et al.
5,258,191 A 11/1993 Hayes
5,259,522 A 11/1993 Morton
5,265,745 A * 11/1993 Pereyra et al. ..... 215/232
5,302,442 A 4/1994 O'Brien et al.
5,342,684 A 8/1994 Carespodi
5,346,082 A 9/1994 Ochs et al.
5,353,665 A 10/1994 Heebner
5,381,913 A 1/1995 Peeters
5,407,751 A 4/1995 Genske et al.
5,415,306 A 5/1995 Luch et al.
5,421,470 A 6/1995 Dudzik
5,433,992 A * 7/1995 Galda et al. ..... 428/201
5,447,792 A 9/1995 Brandt et al.
5,469,968 A 11/1995 Matthews et al.
5,492,757 A 2/1996 Schuhmann et al.
5,500,265 A 3/1996 Ambroise et al.
5,513,781 A * 5/1996 Ullrich et al. ..... 222/565
5,523,136 A 6/1996 Fischer et al.
5,533,622 A 7/1996 Stockley, III et al.
5,551,608 A * 9/1996 Moore et al. ..... 222/542
5,615,789 A 4/1997 Finkelstein et al.
5,626,929 A 5/1997 Stevenson
5,632,004 A 5/1997 Bergstrom
5,664,694 A 9/1997 Bietzer et al.
5,685,443 A 11/1997 Taber et al.
5,702,015 A * 12/1997 Giles et al. ..... 215/232
5,720,401 A * 2/1998 Moore ..... 215/232
5,723,507 A 3/1998 Markovich et al.
5,738,231 A 4/1998 Montgomery
5,756,178 A 5/1998 Obadia
5,773,136 A 6/1998 Alder et al.
5,785,195 A 7/1998 Zwemer et al.
5,788,101 A 8/1998 King
5,837,369 A 11/1998 Grunberger et al.
5,839,592 A 11/1998 Hayes
5,850,951 A 12/1998 Hayes
5,851,640 A 12/1998 Schuhmann et al.
5,860,544 A 1/1999 Brucker
5,862,928 A 1/1999 Breuer et al.
5,875,909 A * 3/1999 Guglielmini ..... 215/350
5,882,789 A 3/1999 Jones et al.
5,884,788 A 3/1999 Wilde
5,902,075 A 5/1999 Krings
5,915,577 A * 6/1999 Levine ..... 215/232
5,915,578 A * 6/1999 Burt ..... 215/250
5,925,430 A 7/1999 Bayer et al.
5,927,530 A 7/1999 Moore
5,929,128 A 7/1999 Whetten et al.
5,947,311 A 9/1999 Gregory
5,973,077 A 10/1999 Kan et al.
5,992,661 A 11/1999 Zumbuhl
5,997,968 A 12/1999 Dries et al.
6,006,930 A 12/1999 Dreyer et al.
6,044,994 A 4/2000 Miller
6,056,136 A 5/2000 Taber et al.
6,056,141 A 5/2000 Navarini et al.
6,068,933 A 5/2000 Shepard et al.
6,082,566 A 7/2000 Yousif et al.
6,082,568 A 7/2000 Flanagan
6,089,390 A 7/2000 Druitt et al.
6,105,800 A 8/2000 Czesak
6,119,422 A 9/2000 Clear et al.
6,119,883 A 9/2000 Hock et al.
6,123,212 A 9/2000 Russell et al.
6,152,316 A 11/2000 Niese
6,152,319 A 11/2000 Kamachi et al.
6,158,604 A 12/2000 Larguia, Sr. et al.
6,165,576 A 12/2000 Freedman et al.
6,179,139 B1 1/2001 Heilman
6,202,871 B1 3/2001 Kelly
6,206,871 B1 3/2001 Zanon et al.
6,213,321 B1 4/2001 Zumbuhl
6,220,466 B1 4/2001 Hayes et al.
6,231,975 B1 5/2001 Kong et al.
6,234,338 B1 5/2001 Searle
6,235,822 B1 5/2001 Whetten et al.
6,237,789 B1 5/2001 Zhu
6,239,210 B1 5/2001 Kim et al.
6,253,939 B1 7/2001 Wan et al.
6,253,940 B1 7/2001 Graham et al.
6,257,430 B1 7/2001 Rinnie et al.
6,265,083 B1 7/2001 Tanizaki et al.
6,276,543 B1 8/2001 German et al.
6,277,478 B1 * 8/2001 Kurita et al. ..... 428/200
6,302,321 B1 10/2001 Reese et al.
6,315,140 B1 11/2001 Nadel
6,382,443 B1 5/2002 Gregory
6,382,445 B1 5/2002 McCandless
6,419,101 B1 7/2002 Hessel et al.
6,477,823 B1 11/2002 Kitterman et al.
6,488,165 B1 12/2002 Hidding
6,502,710 B1 1/2003 Bosl et al.
6,581,793 B1 6/2003 Racine et al.
6,659,297 B2 12/2003 Gregory et al.
6,848,590 B2 2/2005 Brozell et al.
6,854,614 B2 2/2005 Sprick
6,874,647 B2 4/2005 Bloom et al.
6,893,672 B2 5/2005 Ingraham
6,902,075 B2 * 6/2005 O'Brien et al. ..... 215/232
6,913,157 B2 7/2005 Oh
6,915,918 B2 * 7/2005 Merrill ..... 215/232
6,948,630 B2 * 9/2005 Julian et al. ..... 215/43
7,004,340 B2 2/2006 Belden, Jr.
7,021,478 B1 4/2006 Hock
7,168,581 B2 * 1/2007 Robinson et al. ..... 215/349
7,175,039 B2 2/2007 German et al.
7,217,454 B2 * 5/2007 Smelko et al. ..... 428/319.1
7,314,669 B2 1/2008 Galloway
2001/0012868 A1 8/2001 Chen et al.
2002/0027123 A1 3/2002 Druitt et al.
2002/0066713 A1 6/2002 Ma
2002/0162818 A1 11/2002 Williams
2003/0071007 A1 4/2003 Ma et al.
2003/0098285 A1 5/2003 Gregory et al.
2003/0116524 A1 6/2003 Robinson et al.
2003/0150833 A1 8/2003 Shenkar
2004/0055992 A1 3/2004 Robinson et al.
2004/0173944 A1 9/2004 Mueller et al.
2005/0003125 A1 1/2005 Barber et al.
2005/0048233 A1 3/2005 Nomula
2005/0077297 A1 4/2005 Marshburn et al.
2005/0077298 A1 4/2005 Nomula
2005/0211657 A1 9/2005 Mallet et al.
2005/0284837 A1 12/2005 Taber et al.
2007/0125785 A1 6/2007 Robinson et al.
2007/0138125 A1 6/2007 Granger
2007/0187352 A1 8/2007 Kras et al.
2008/0083694 A1 4/2008 Ammann
2008/0290060 A1 11/2008 Ammann
2009/0026165 A1 1/2009 Ammann

FOREIGN PATENT DOCUMENTS

DE 3237634 4/1984
DE 4206244 9/1993
EP 0269920 6/1988
EP 275102 7/1988
EP 405365 1/1991
EP 0421821 4/1991
EP 589033 10/1993
GB 2034288 6/1980
JP 1308772 12/1989
JP 02205574 8/1990
JP 02219769 9/1990
JP 2000052982 2/2000
JP 2001261054 9/2001
WO 9009935 1/1990
WO WO-9321262 10/1993
WO 2006002922 1/2006
WO WO-2007042205 4/2007

* cited by examiner

FIG. 11A
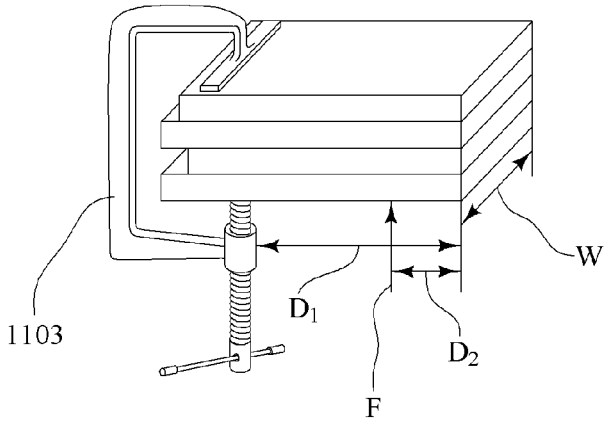
FIG. 11B
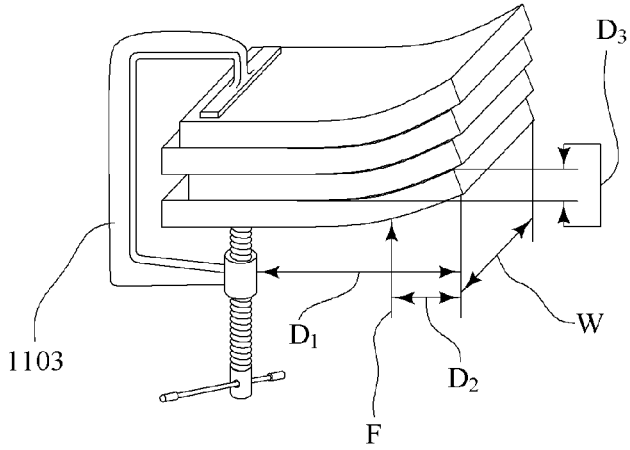
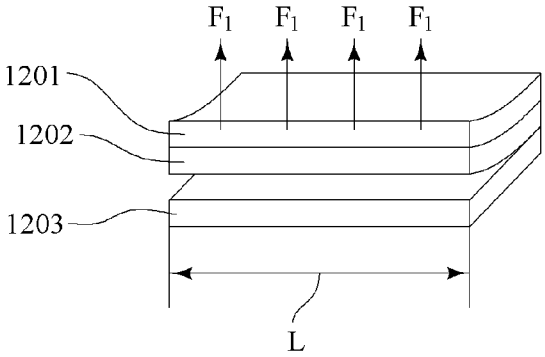
FIG. 12

PEELABLE SEAL FOR AN OPENING IN A CONTAINER NECK

CROSS-REFERENCE TO RELATED APPLICATIONS

This patent application is a continuation-in-part of and claims priority to and benefit from, currently pending, U.S. Nonprovisional patent application Ser. No. 11/181,576, filed on Jul. 14, 2005, which is incorporated herein by reference.

STATEMENT REGARDING FEDERALLY SPONSORED RESEARCH OR DEVELOPMENT

Not applicable.

REFERENCE TO A "SEQUENTIAL LISTING," A TABLE, OR A COMPUTER PROGRAM LISTING APPENDIX SUBMITTED ON A COMPACT DISC

Not applicable.

BACKGROUND OF THE INVENTION

1. Field of the Invention

The present invention relates generally to container inner seals, and, more specifically, to inner seals having a stiffening structure which promotes ease of removal by allowing the user to loosen or remove the inner seal by flicking an overhanging portion with a finger or other means and peeling.

2. Description of the Related Art

In view of the need for airtight inner seals on containers for food, medicine, and the like, closures have been developed which incorporate an inner seal bonded with a sealant to an upper rim of a container rim (i.e., the landing area of the container neck). Traditional inner seals typically have an integral pull tab to grip to facilitate removal of the inner seal, or no pull tab at all, forcing the user to resort to sharp objects to scrape, puncture, or break the inner seal. These traditional inner seals thus have numerous shortcomings. Although inner seals having integral tab portions are designed for gripping, end users—particularly the elderly—may find it difficult forming the required thumb and forefinger connection to pinch and pull the tab of the inner seal up and away form the upper container rim. Scraping or puncturing the inner seal with sharp objects such as knives can be dangerous to the end user. Therefore, there is a need for inner seals which are easily removed by the end user, particularly those who cannot pinch and pull a tab, and that do not require sharp and dangerous objects to puncture the inner seal.

SUMMARY OF THE INVENTION

In view of known deficiencies associated with earlier inner seals, there is provided an inner seal or liner having one or more layers. The inner seal has a central portion or body and optionally an overhanging portion extending beyond the margin or fringe of the central portion of the inner seal. In a single-layer inner seal, the inner seal includes a stiffening structure, such as a co-extruded film actually consisting of a plurality of materials. In a multi-layer inner seal, the inner seal includes the stiffening structure (or layer), and can further include an intermediate layer and a structure adapted for sealing or bonding the inner seal against an upper rim of a container (or landing area of a container neck). These layers may be stacked in the order recited, and are secured together in a composite sheet with adhesives known in the art.

In an embodiment of the seal having an overhanging portion, the overhanging portion may circumscribe the periphery of the central portion or body of the inner seal, and includes the stiffening structure, which facilitates removal of the inner seal by flicking the overhanging portion with a finger or other part of the hand or even retaining it within the closure. The invention thus provides an inner seal easily removed not by pinching (i.e. applying more than one force) the seal or pulling a tab, which some elderly people in particular might find difficult to perform, or by gouging the seal with a sharp object, which is dangerous, but by flicking (i.e. applying a single force) an overhanging portion with a digit or other part of the hand or by retaining the inner seal within the closure so that the inner seal is loosened or removed from the landing area of the container neck. The inner seal may be of any size or shape of inner seals known in the art, such as disc-shaped.

For a better understanding of the present invention, together with other and further objects thereof, reference is made to the following description, taken in conjunction with the accompanying drawings, and its scope will be pointed out in the appending claims.

BRIEF DESCRIPTION OF THE DRAWINGS

The aspects and advantages of the present invention will be better understood when the detailed description of the embodiments taken in conjunction with the accompanying drawings, in which:

FIG. 11A is a perspective view of the apparatus used in performing the flex test of Example 1;

FIG. 11B is a perspective view of the apparatus of FIG. 11A wherein the strips of material are shown deflected with an applied force; and FIG. 12 is a perspective view of the apparatus used in performing the peel test of Example 2.

DETAILED DESCRIPTION

While this invention is susceptible of embodiments in many different forms, there are shown in the Figures and will herein be described in detail, embodiments of the invention with the understanding that the present disclosure is to be considered as an exemplification of the principles of the invention, and is not intended to limit the broad aspects of the invention to the embodiments illustrated.

Figure 1:
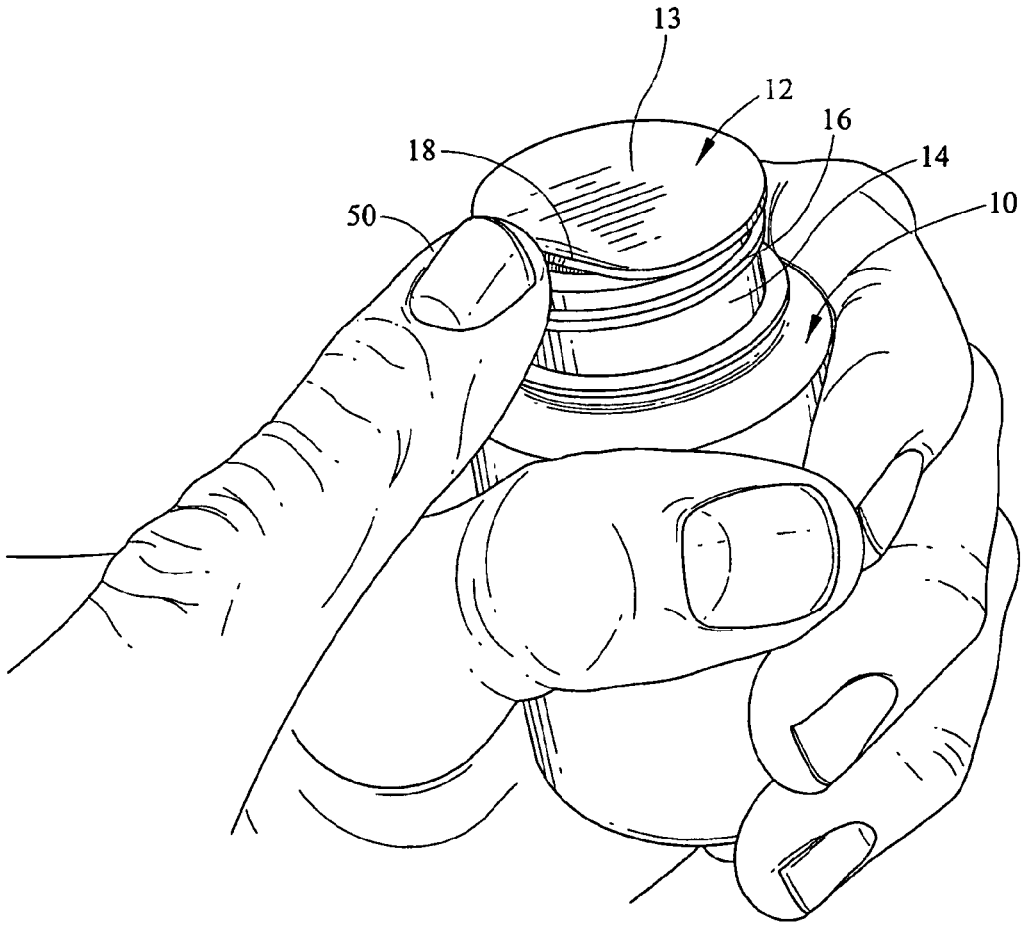
FIG. 1 is a perspective view of a peelable seal of the present invention on a container in a use condition.

As shown in FIG. 1, a peelable seal 12 having a central body portion 13 with an overhang portion 18 is attached to a neck 14 of a container 10. The seal 12 is easily loosened with the "flick" or application of a single force with the meat of a finger 50 or other part of the hand, so that it may be readily peeled off without the need to pinch or apply more than one force.

Figure 2:
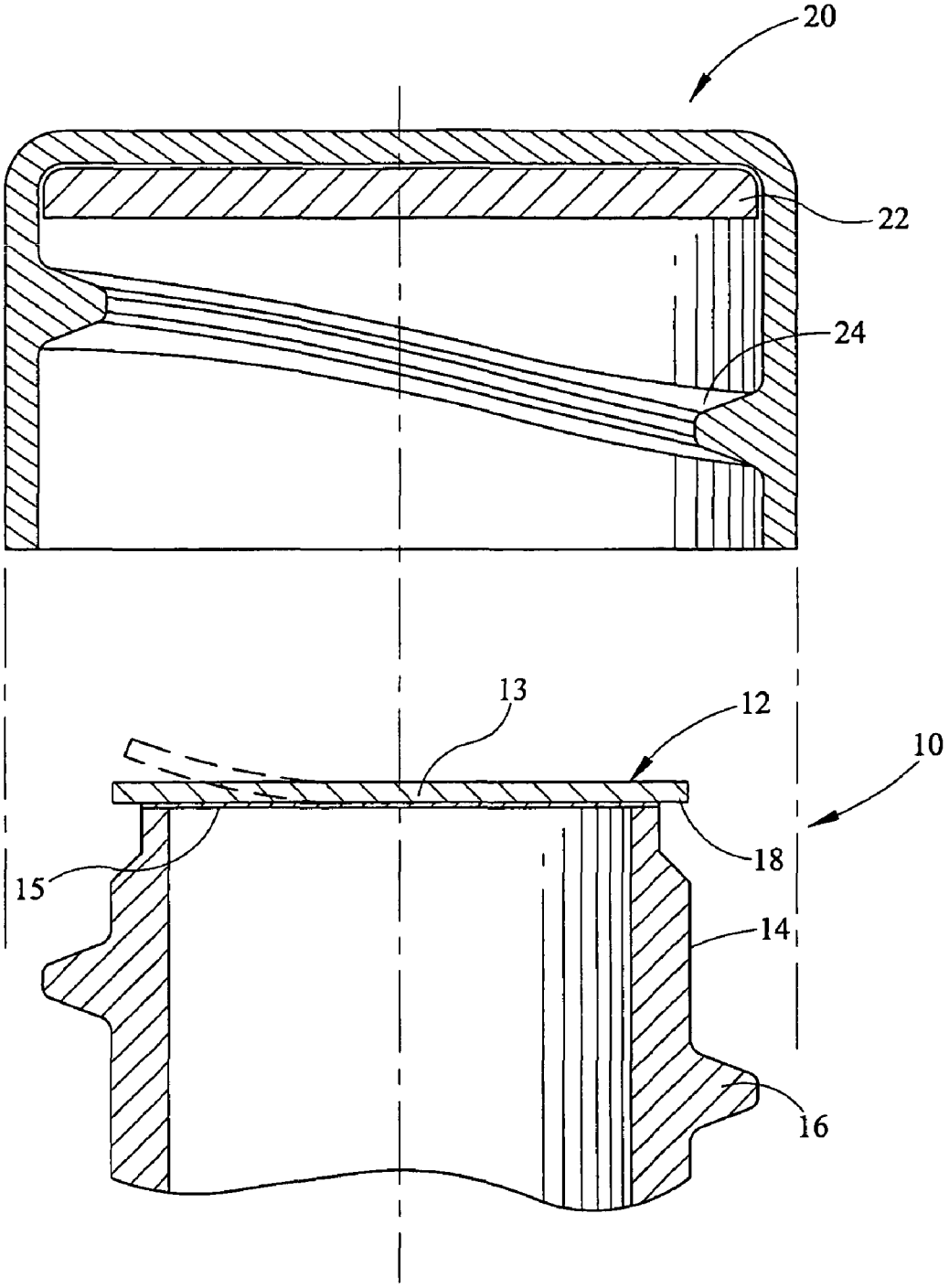
FIG. 2 is an exploded view, in section, of a peelable seal with a container and a cap, according to an embodiment of the present invention.

An embodiment of the peelable seal of the present invention is generally disc-shaped as shown in FIGS. 1, 2 and indicated by the numeral 12. The seal 12 can be associated with a wide variety of closure-container combinations, and the closure-container combination depicted in the Figures is shown as an example only. As shown in FIG. 2, the peelable seal 12 is sealingly secured over the opening to the neck 14 of container 10. Neck 14 is provided with outer container threads 16 which are engageable with closure engaging threads 24 of closure 20. Closure 20 is further provided with a backing 22 which is a resilient structure separate or integral with the closure 20.

Figure 3:
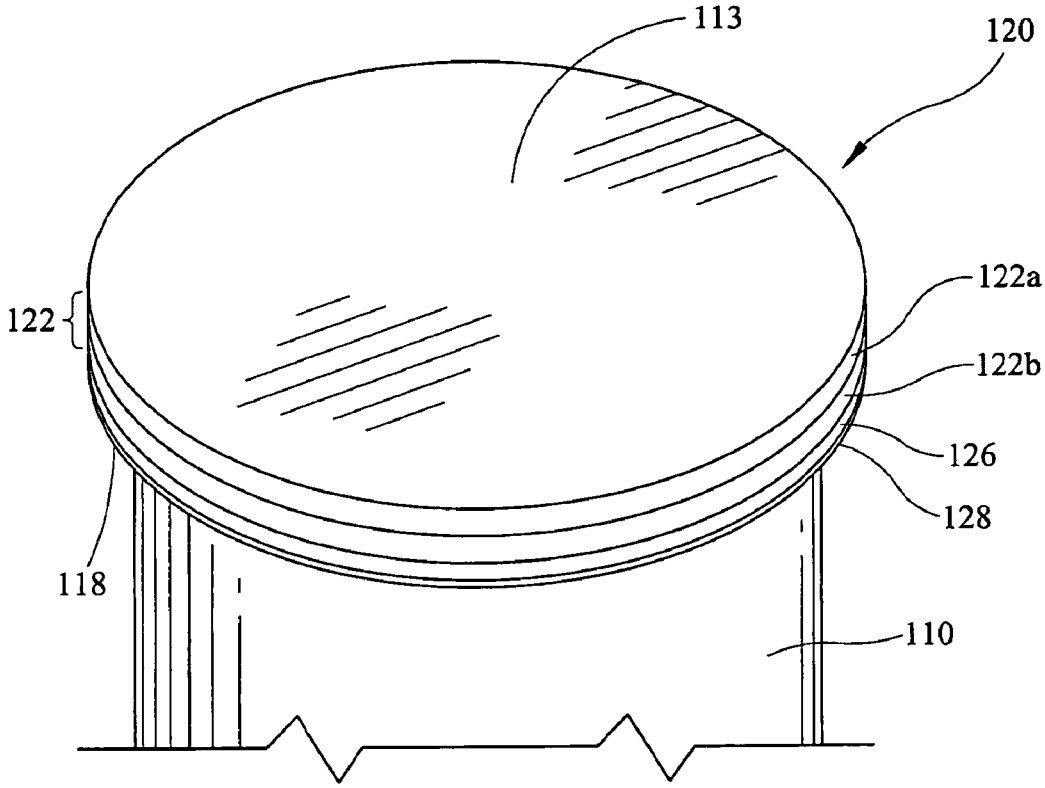
FIG. 3 is a perspective view of a peelable seal of the present invention.

As shown in FIG. 2, the seal 12 may be formed in a single layer with a central portion or body 13, and an overhanging portion 18 extending beyond the margin or fringe of the central portion 13 of the seal 12. The seal 12 may also include a plurality of layers, as is best shown in FIG. 3, including a sealant 128. As shown in FIG. 2, a sealant 15 (or bonding layer), is used for attachment to the rim of neck 14. The sealant may be formed of polypropylene, polyethylene ethylene vinyl acetate copolymer (EVA), polyester or a similar heat sealable material having relatively low density and tensile strength, and applied to the seal 12 on a side adjacent to the rim of the neck 14. Preferably, the sealant 15 would be the same material as the container 10.

In a single-layer seal 12 configuration, the seal 12 may include a stiffening structure, such as a co-extruded film actually consisting of a plurality of materials. The single-layer seal 12 configuration would be a construction in which a hot iron (not shown) is used to bond the seal to the upper rim of a container 10 (or landing area of a container neck 14). The materials should be stiff such that the seal 12 could be "flicked" with a finger as shown in FIG. 1 or with any part of the hand to loosen it, and then peeled off without the need to pinch, typically accomplished by forming the forefinger and thumb into a gripping configuration. In the single-layer seal configuration, the stiffening structure may be as thin as about 0.010 inches thick, and the sealant may be about 0.0001 inches thick.

A multi-layer seal 120 as shown in FIG. 3 may include a layer 122 of a stiffening structure; an intermediate layer 126; and a sealant structure 128. The intermediate layer 126 may be a foil layer, and may be any metallic foil, preferably a stiff metallic material such as for example, aluminum. The bottom of sealant structure 128 can be adapted for sealing or bonding the seal against the upper rim of a container 110 (or landing area of a container neck). These layers may be stacked in the order recited or other order, and are secured together in a composite sheet with adhesives known in the art. In defining the stacked layer seal 120, seal 120 includes a central body portion 113 which covers the opening of a container and has an outer peripheral edge or overhanging portion 118. In this embodiment, the layer 122 would preferably be from about 0.010 to 0.25 inches of combined backing materials for stiffening; the intermediate layer 126 would preferably be from about 0.001 inches thick to about 0.010 inches thick and the sealant would preferably be from about 0.0001 to 0.0002 inches thick, for an overall thickness of from about 0.01 inches to about 0.025 inches.

In one embodiment, the multi-layer peelable seal 120 configuration is comprised of a layer 122 of about 0.0120 inches thick, an intermediate layer 126 of about 0.0015 inches thick, and a sealant 128 of about 0.0010 inches thick, for an overall thickness of about 0.0145 inches. In this configuration, the layer 122 includes about 0.0020 inches of polyester (PET) and about 0.0100 inches of polypropylene (PP).

In yet another multi-layer seal configuration, seal 120 is comprised of a layer 122 of about 0.0410 inches thick, an intermediate layer 126 of about 0.0015 inches thick, and a sealant 128 of about 0.0010 inches thick, for an overall thickness of about 0.0435 inches. In this configuration, the layer 122 includes about 0.0400 inches of rubber modified polypropylene thermoplastic elastomer 122*a* and about 0.0010 inches of PP 122*b*.

The backing material which provides stiffening structure to the top layer 122 may be generally selected from any solid material providing an adequate stiffening structure such as, for example, polyethylene terephalate (PET), polypropylene (PP), Nylon, polyethylene (PE), polyvinylchloride (PVC), styrene, ethylene-vinyl-acetate (EVA), ethylene-vinyl-alcohol (EVOH), Vinyl, foams of the preceding materials, paper, a stiff metallic material such as aluminum or steel, or combinations thereof. The preferred backing materials are PET, PP, PVC, a stiff metallic material or paper.

The peelable seal 12 or 120 may be applied to a container in a conventional manner. The seal 12 or 120 typically is placed inside a closure 20 by a closure manufacturer, and the closures 20 typically are supplied to a packager of the container with the seals 12 or 120 retained within the closure 20. The seal 12 or 120 is sealed to a container 10 by methods that will be recognized by those skilled in the art. The closure 20 is attached to the neck 14 of the container 10. The central portion 13, 113 or body of the seal 12, 120 shown in the figures is of substantially the same size and configuration as the opening or mouth of the container 10. In the embodiments shown, the seals 12, 120 include the overhanging portion 18, 118 circumscribing the peripheral edge of the body 13, 113 of the seal 12, 120. The depth of the overhanging portion 18, 118 extends from the peripheral edge of the body portion 13, 113 beyond the rim of the container 10, usually to the extent of from about 0.0050 inches to about 0.2500 inches. The preferred depth of the overhanging portion 18, 118 is about 0.0620 inches. The overhanging portion 18, 118 facilitates removal of the seals 12, 120 by one opening the container 10. Instead of pinching and pulling a tab with the thumb and forefinger, or having to remove the seal with a knife or other sharp object, as in other conventional seals, the user flicks the overhanging portion 18, 118 with the meat of the finger 50 or other part of the hand to loosen it, and the stiffening structure provides sufficient rigidity or resistance so that when the meat of the finger 50 meets the overhanging portion 18, 118, the seals 12, 120 pop up from the land area of the neck. The seals 12,120, in other words, are not flaccid like traditional inner seals.

Figure 4:
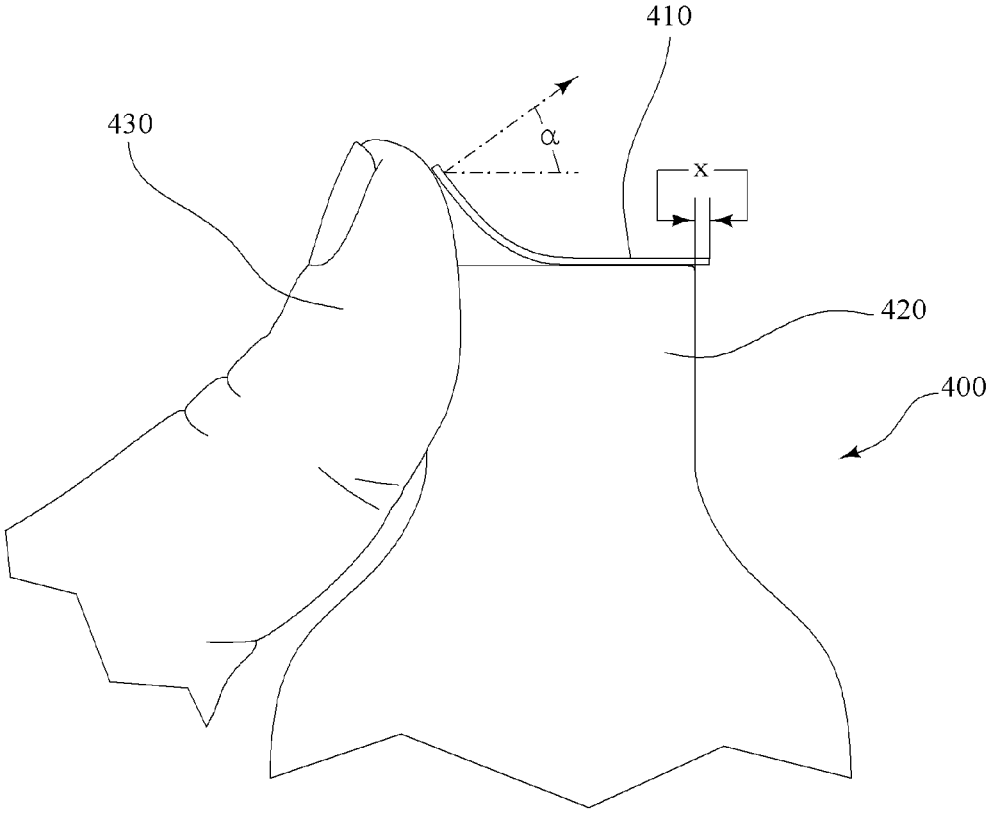
FIG. 4 is a side view of an embodiment of the peelable seal being removed from a container neck.

FIG. 4 shows peelable seal 410 being removed from container neck 420. In this embodiment, container 400 has container neck 420 without threads. Hence, seal 410 functions as a closure as well as a peelable seal. Removal of seal 410 is accomplished by applying a force at an angle $\alpha$ with respect to seal 410. An individual's thumb 430 is shown here applying a removal force; however it is to be understood that the peelable seal of the present invention is designed to be removable from a container without the need to pinch the seal. Therefore, the present invention is not limited to any specific removal force. Instead, the material(s) and or layer(s) making up peelable seal 410 are described herein as having the properties of enabling removal without the need to pinch and hence, there is no limitation on the type of force used to remove seal 410. Angle α needs to have a vertical component thereto and is preferably between 0° and 90° and more preferably is about 45°. Peelable seal 410 overhangs an outer rim of the container by a distance x for providing a surface to flick seal 410 loose from container neck 420. Preferably distance x is sufficient for a user to use their thumb 430 or other portion of the hand to exert a sufficient removal force on seal 410. More preferably distance x is greater than 0.03 inches, and most preferably distance x is in a range of 0.070 to 0.085 inches. Preferably, the peel force applied to seal 410 at an angle α of 45° need not exceed 1500 g. or about 14.7N., where N is newtons, enabling seal 410 to be removed by flicking with a portion of the hand. Most preferably, the necessary peel force applied to seal 410 at an angle α of 45° is between 900 g. and 1100 g., or between about 8.8 N. and 10.8 N. to effect removal or flick from container neck 420.

Figure 5:
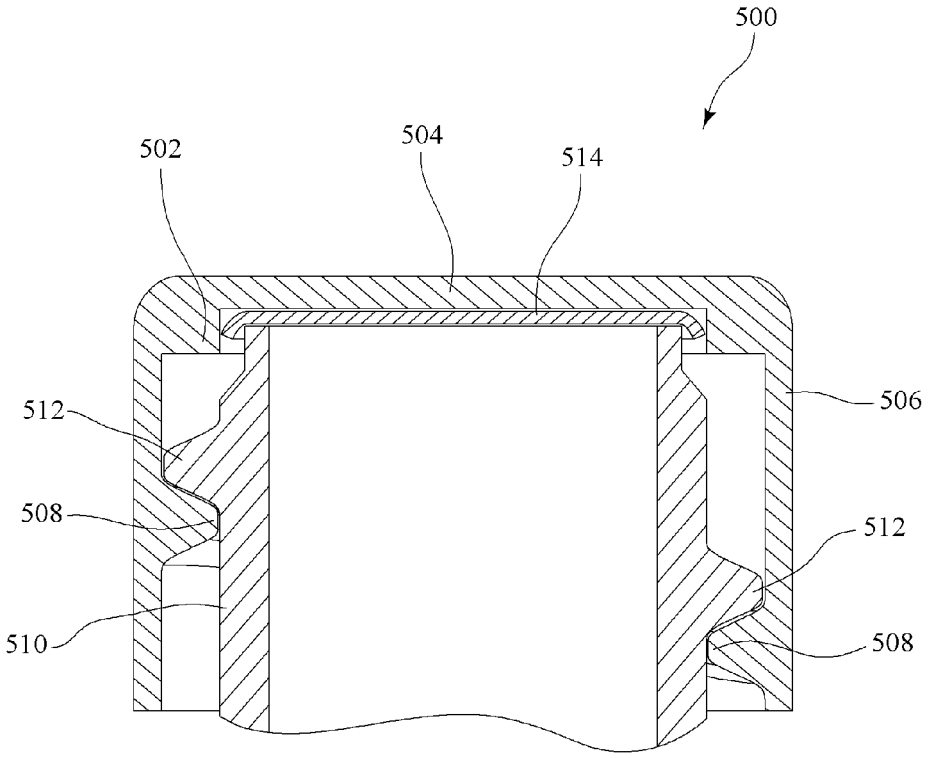
FIG. 5 is a cross-sectional view of an embodiment of the peelable seal on a container neck and within a closure having a compression ring.

FIG. 5 shows peelable seal 514 on container neck 510 and within closure 500. Closure 500 has sidewall 506 with helical thread 508 projecting from an inner annular surface thereof for engaging helical thread 512 on an outer surface of container neck 510. In this embodiment, closure 500 has compression ring 502 as an integral part thereof projecting inward from top wall 504 and side wall 506. Compression ring 502 bends the outer rim of seal 512 downward into a cupped configuration wherein closure threads 508 do not flick seal 514 loose when closure 500 is removed from container neck 510.

Figure 6A:
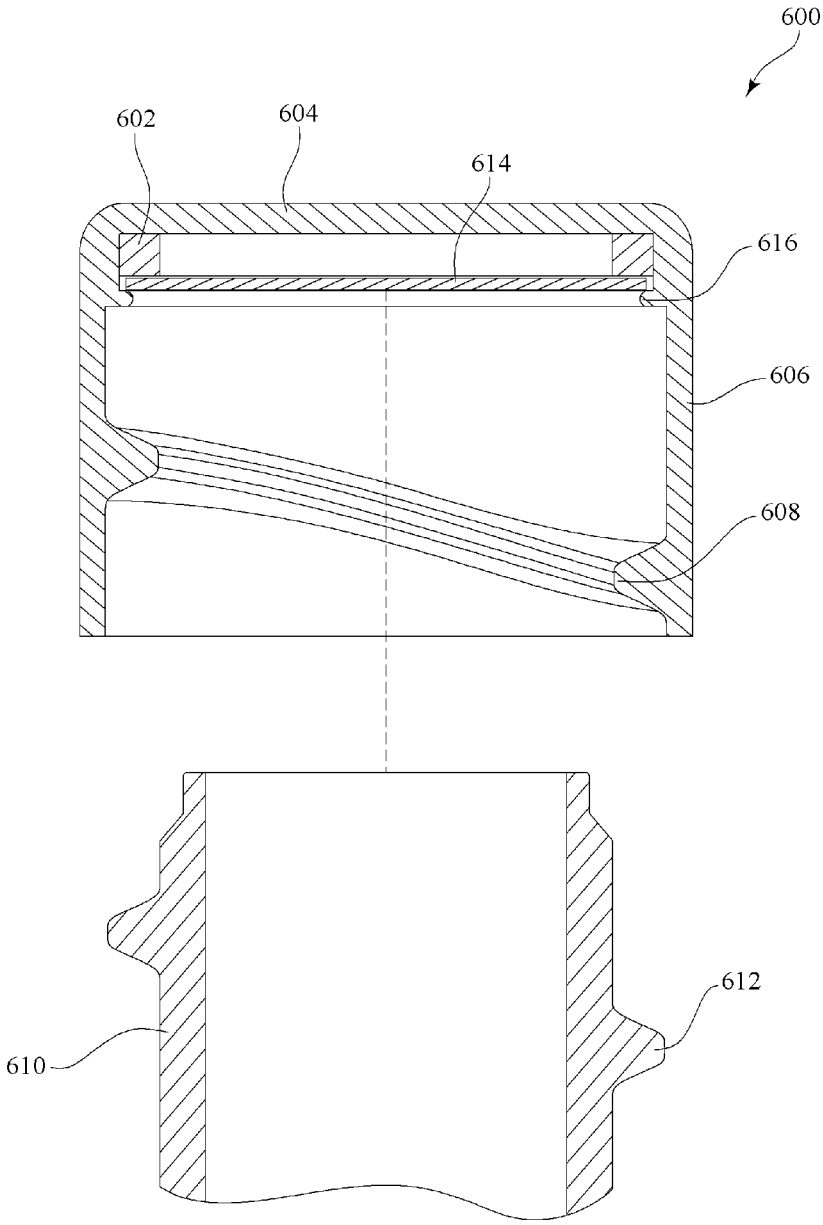
FIG. 6A is a cross-sectional view of an embodiment of the peelable seal removed from a container neck and held within a closure having a retaining ring and a compression ring.
Figure 6B:
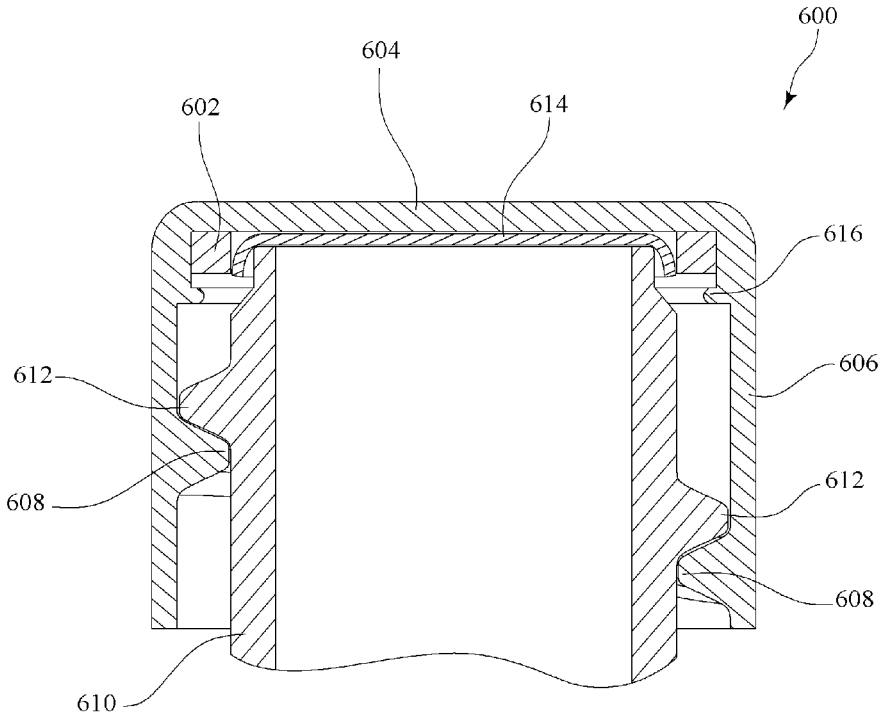
FIG. 6B is a cross-sectional view of the embodiment of the peelable seal shown in FIG. 6A sealed onto the container neck.

FIGS. 6A and 6B show peelable seal 614 within closure 600 wherein FIG. 6 A shows closure 600 removed from container neck 610 and FIG. 6B shows closure 600 engaged with container neck 610. Closure 600 has sidewall 606 with helical thread 608 projecting from an inner annular surface thereof for engaging helical thread 612 on an outer surface of container neck 610. In this embodiment, closure 600 has compression ring 602 adjacent an inner surface of top wall 604 and side wall 606. Below peelable seal 614 is retaining ring 616 projecting inward from an inner annular surface of side wall 606. Retaining ring 616 functions to retain seal 614 within closure 600 when closure 600 remains free from engagement with container neck 610. as shown in FIG. 6A. Compression ring 602 bends the outer rim of seal 614 downward into a cupped configuration when closure 600 engages container neck 610, as shown in FIG. 6B. In this cupped configuration, when closure 600 is removed from container neck 610, peelable seal 614 remains sealed on container neck 610 since retaining ring 616 and closure threads 608 do not flick seal 614 loose when closure 600 is removed from container neck 610.

Figure 7:
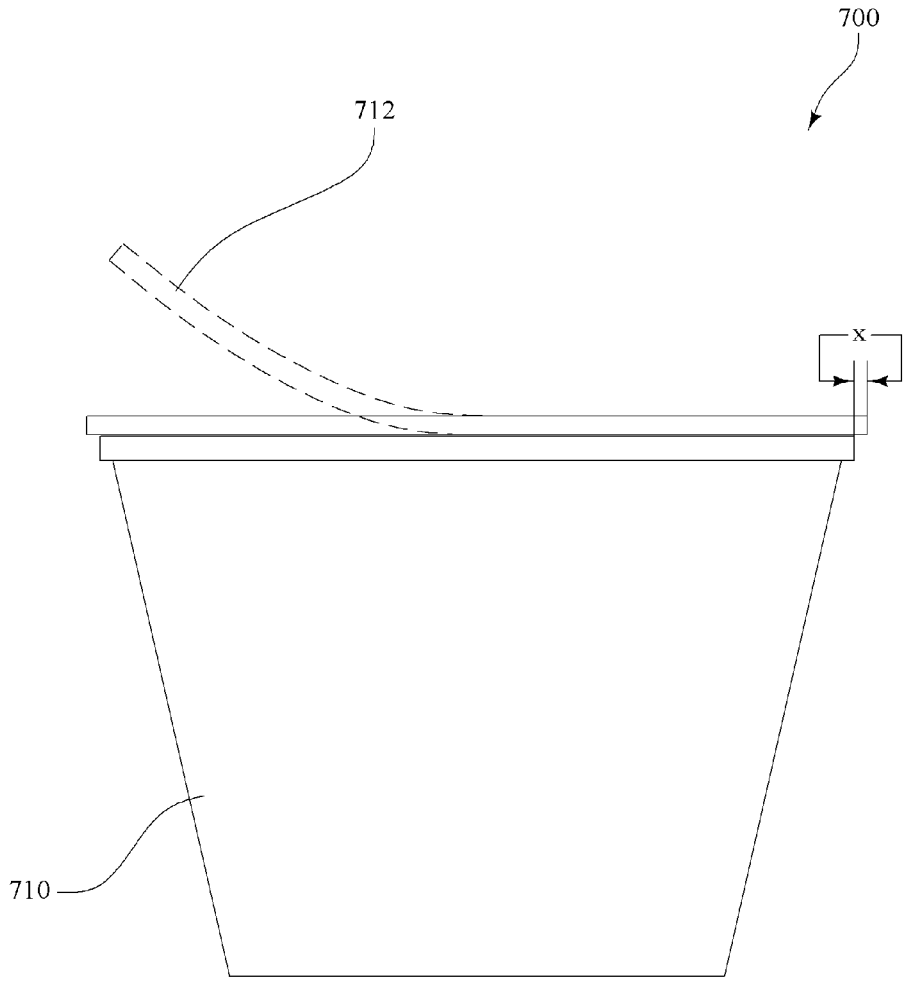
FIG. 7 is a side view of an embodiment of the peelable seal functioning as a closure.

FIG. 7 shows container 710 having peelable seal 700 on an upper annular opening functioning as a closure as well as a seal. Seal 700 has an outer rim overhanging the upper annular opening of container 710 by a distance of x. Preferably distance x is sufficient for a user to use their thumb or other portion of the hand to exert a sufficient removal force on seal 700, more preferably distance x is greater than 0.03 inches, and most preferably distance x is in a range of 0.070 to 0.085 inches. Upon the exertion of a sufficient removal force on seal 700, preferably less than 14.7 N at 45°, seal 700 is flicked loose from container 710 as shown in dashed lines 712.

Figure 8:
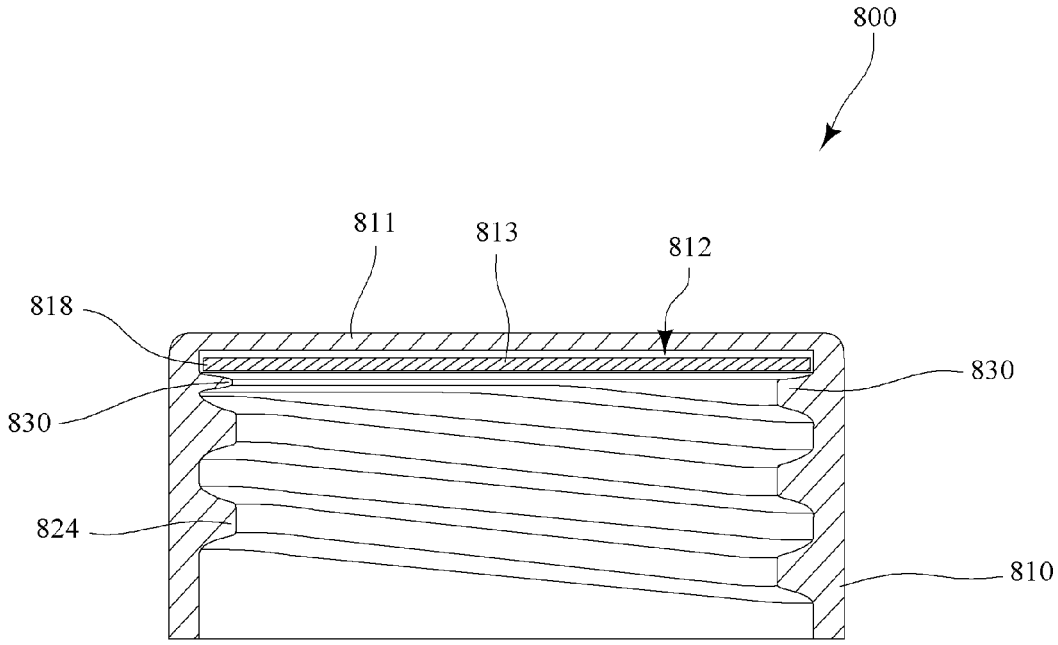
FIG. 8 is a cross-sectional view of a peelable seal of the present invention in a cap having a seal retainer cooperating with an overhanging portion.

FIG. 8 shows peelable seal 812 of the present invention in cap 800 having a seal retainer 830. Peelable seal 812 may be applied to a container in a conventional manner. Seal 812 typically is placed inside closure 800 by a closure manufacturer and rotatingly axially retained therein by seal retainer 830. In this embodiment, seal retainer 830 is an extension of helical thread 824 having substantially a zero pitch near top wall 811. Seal 812 is sealed to a container by methods that will be recognized by those skilled in the art. The central portion 813 of seal 812 is of substantially the same size and configuration as the opening or mouth of a container neck with which it will be sealed. In this embodiment, overhanging portion 818 circumscribes the peripheral edge of central portion 813 of the seal 812 beyond retainer 830. The overhanging portion 818 facilitates removal of seal 812 from a container upon the removal of closure 800 from a container. The user removes closure 800 from the container by rotating closure 800 in a counterclockwise direction engaging helical thread 824 on the inner annular surface of side wall 810 with a helical thread on the closure. Overhanging portion 818 is retained by seal retainer 830 and seal 812 is removed therewith.

Figure 9:
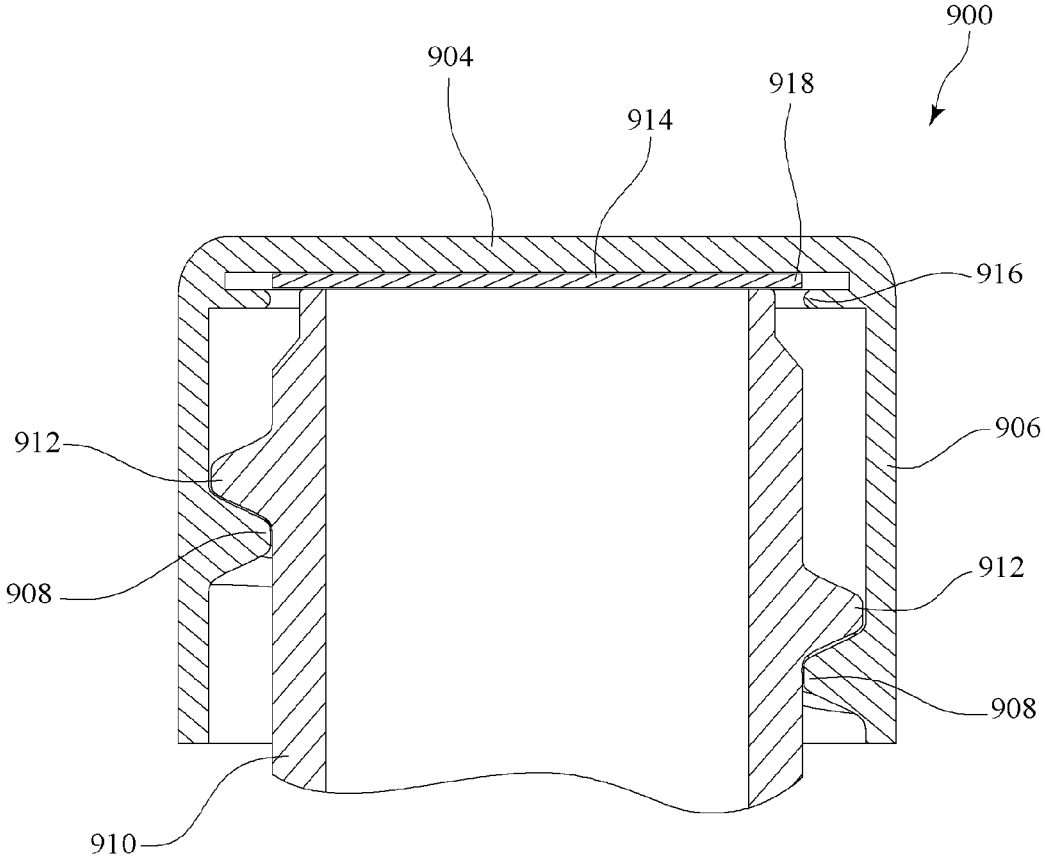
FIG. 9 is a cross-sectional view of an embodiment of the peelable seal engaged with a container neck wherein the peelable seal has been heat shrunk to an extent providing removal clearance between the peelable seal and a retaining ring as well as the container threads.

FIG. 9 shows a cross-sectional view of peelable seal 914 engaged on container neck 910 after heat sealing. Peelable seal 914 is comprised of a material or materials that shrink when heated. Prior to heat sealing peelable seal 914 onto an upper rim of container neck 910, peelable seal 914 has a diameter in excess of the diameter of the inner edge of retaining ring 916, thus is retained within closure 900 proximate top wall 904. Closure 900 has helical thread 908 projecting from an inner surface of sidewall 906 engaged with helical thread 912 projecting from an outer annular surface of closure neck 910. After engagement, peelable seal 914 is heat sealed onto an upper rim of container neck 910 wherein peelable seal 914 shrinks in diameter sufficiently to not interfere with retaining ring 916 and helical thread 908 when closure 900 is removed from container neck 910, while retaining sufficient overhang 918 beyond container neck 910 to permit flicking of seal 914. Heat sealing of peelable seal 914 onto container neck 910 may be done in a variety of ways such as in a retort process, by induction, conduction, heat welding, or other heat sealing process as is known in the art.

EXAMPLES

Example 1

A flex test was performed on selected materials of construction of the peelable seal according to the following procedure and as referenced in FIGS. 11A and 11B.

1. A sheet of polypropylene (PP) was formed having a thickness varying between 0.015 inches and 0.025 inches, with an average thickness of about 0.02 inches.
2. Four strips of the sheet of material were cut having about a 1 inch width W as shown in FIGS. 11A and 11B.
3. The four strips were stacked having their 1 inch widths W and an outer end adjacently aligned.
4. A clamp 1103 was placed about the stacked strips at a distance $D_1$ of about 1 inch from the outer end.
5. A substantially perpendicular force F was applied to the stacked strips at about ⅞ of an inch from the clamp 1103 proximate the adjacently aligned outer end ($D_1$-$D_2$).
6. The displacement $D_3$ of the four strips was measured at various recorded forces.
7. A sheet of polyethylene terephalate (PET) was formed having a thickness varying between 0.015 inches and 0.025 inches, with an average thickness of about 0.02 inches.
8. Steps 2-6 were repeated with the PET strips.

Figure 10:
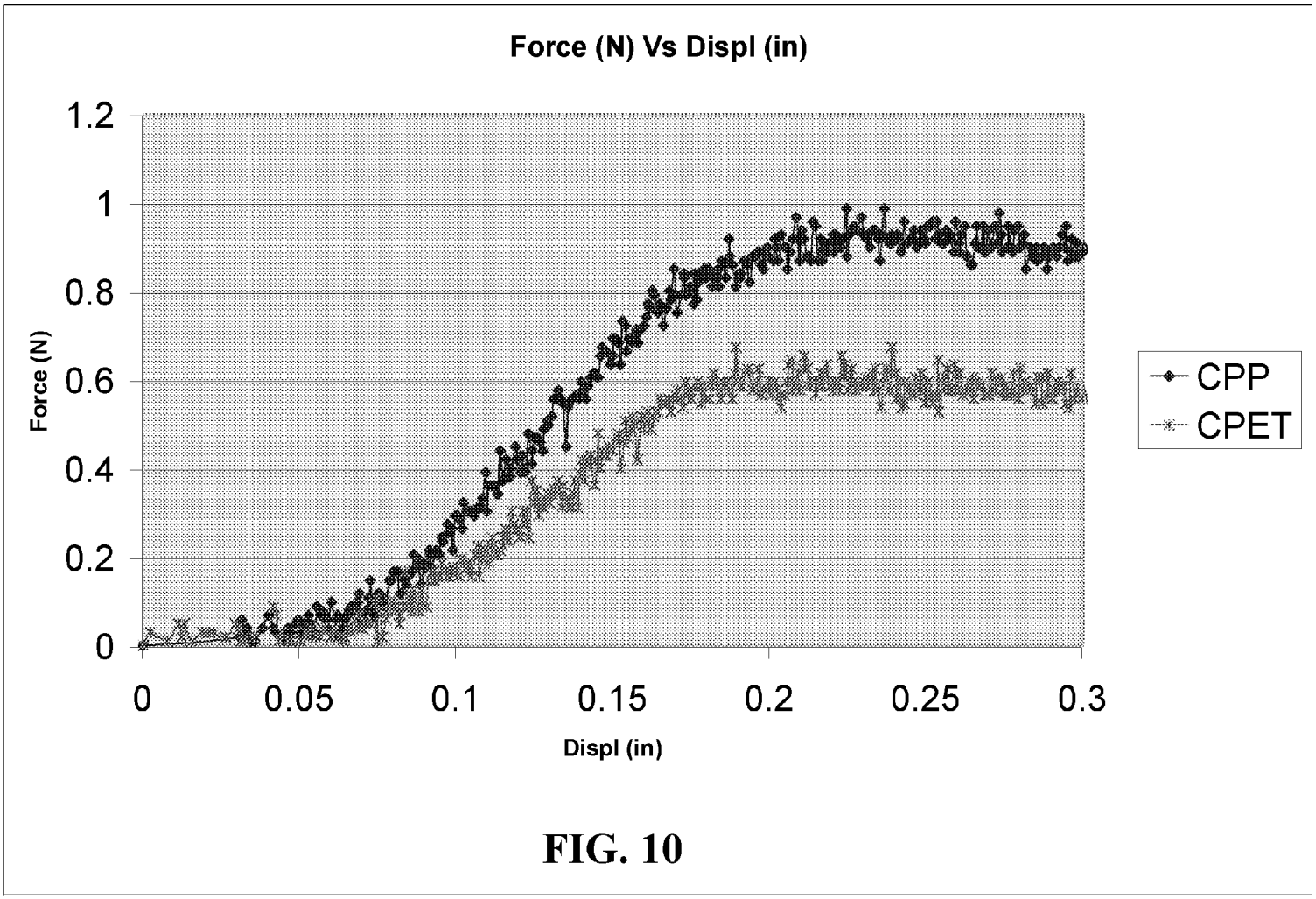
FIG. 10 is a graphical representation of displacement force data generated in Example 1.

The recorded data was plotted and is shown in FIG. 10. It was shown that a force of about 0.9 N is sufficient to displace four layers of PP while about 0.6 N of PET is sufficient to displace four layers of PET. Hence, it is deduced that a single layer of PP having the thickness herein tested requires about 0.225 N while a single layer of PET having a thickness herein tested requires about 0.15 N for adequate displacement.

Example 2

A peel test was performed on selected materials of construction of the peelable seal according to the following procedure and as shown in FIG. 12.

1. A strip of coextruded material having a width L of about 1 inch was prepared having layer 1203 of PP and layer 1202 of a copolymer (PP and polyethylene (PE)).
2. The copolymer side 1202 of the layered strip was heat sealed to a homogeneous sheet 1201 of PP at 400° F. under 50 psi for about 1 second to form a composite strip.
3. The sealed strip was placed in a tensile tester with the PP side 1203 of the coextruded layer on top.
4. A tensile force $F_1$ was exerted across the 1 inch edge L of the coextruded material at about 90° with respect to the composite strip until the copolymer layer 1202 of the 1 inch strip separated from PP layer 1203 and remained with the sheet of PP 1201.
5. The removal force was recorded.

It was shown that a removal force between about 900 g and 1300 g or about 8.8 N and 12.7 N with an average of about 1100 g. or 10.8 N was required to peel the PP layer of the coextruded strip from the copolymer layer wherein the copolymer layer was retained with the sheet of PP.

Examples 1 and 2 demonstrate embodiments of the present invention wherein a peelable seal has appropriate stiffness or flexibility and adhesion qualities to enable the flicking of a peelable seal from a container neck without the need to pinch the seal. The materials selected for these examples are not to serve as a limitation on the present invention but only to demonstrate desired characteristics of materials as other materials known by persons having ordinary skill in the art provide the desired characteristics.

While there have been described several embodiments of the present invention, those skilled in the art will recognize that other and further changes and modifications may be made thereto without departing from the spirit of the invention, and it is intended to claim all such changes and modifications as fall within the true scope of the invention.

What is claimed is:

1. A unitary liftable seal for use in sealing a container opening comprising:

at least one generally disc shaped layer of material having a total thickness of between about 0.01 inches and 0.25 inches;

said unitary liftable seal having an overhanging portion extending outwardly from said container opening at least 0.005 inches beyond an outer surface of said container;

said unitary liftable seal having sufficient rigidity and adhesion about said container opening to resist folding and release from said container under the application of a singular force of up to 14.7N applied to an underside surface of said seal overhanging portion;

wherein said unitary liftable seal is maintained in substantially a singular horizontal plane extending about and above said container opening; and wherein said unitary liftable seal rigidity is responsive to said application of said singular force to separate said unitary liftable seal from said container opening and maintain said substantially singular horizontal plane.

2. A container assembly, comprising:

a cap engageable with a container;

said container having a neck with a container rim surrounding an opening;

an inner liftable seal secured by adhesive over said opening, said inner seal maintained in a substantially singular horizontal plane over said container rim and having a top planar surface and a bottom planar surface, said inner liftable seal including;

a first layer including a stiffening structure;

a foil layer disposed between said first layer and said container rim;

a sealant layer adhering said inner liftable seal to said container rim; and, an overhanging portion of said inner liftable seal circumscribing said container rim;

wherein when a singular force is applied to said bottom planar surface of said overhanging portion of said inner liftable seal, said inner liftable seal has substantially sufficient rigidity responsive from said singular force causing separation of said inner liftable seal from said container rim while maintaining said substantially singular horizontal plane.

3. The container assembly of claim 2, wherein said first layer is selected from the group consisting of polypropylene, polyethylene terephalate, polyvinylchloride, a stiff metallic material, and paper.

4. The container assembly of claim 3, wherein said sealant layer is comprised of polypropylene, polyethylene, ethylene vinyl acetate copolymer, polyester, or an adhearable material having a relatively low density and tensile strength.

5. The container assembly of claim 2, wherein said foil layer is aluminum foil.

6. The container assembly of claim 2, wherein said first layer is between about 0.010 inches and about 0.25 inches in thickness.

7. The container assembly of claim 2, wherein said foil layer is from about 0.001 inches to about 0.010 inches in thickness.

8. The container assembly of claim 2, wherein said overhanging portion extends from about 0.005 inches to about 0.25 inches beyond said neck.

9. A unitary liftable seal for sealing a container comprising:

a first layer composed of a stiffening structure;

a sealant disposed on said first layer so as to be adaptable for attachment of said first layer about an opening surrounded by a container rim of a container;

an overhanging portion of said first layer of sufficient size to extend beyond said container rim and for engagement with the meat of a finger;

said unitary liftable seal is maintained in a substantially singular plane over said container rim and includes a planar underside surface;

wherein when a single force from the meat of a finger is directly applied to said planar underside surface of said seal overhanging portion, said first layer being of such thickness and rigidity to respond to said application of said single force such that said unitary liftable seal can be loosened from said container rim and maintain said substantially singular plane.

10. The unitary liftable seal of claim 9 wherein said single force is less than 14.7 N.

11. The unitary liftable seal of claim 10 wherein said single force is between about 8.8 N. and 10.8 N.

12. The unitary liftable seal of claim 9 wherein said overhanging portion of said first layer extends beyond said container more than 0.03 inches.

13. The unitary liftable seal of claim 12 wherein said overhanging portion of said first layer extends beyond said container in a range of 0.070 and 0.085 inches.

14. The unitary liftable seal of claim 9, wherein said first layer is selected from the group consisting of polypropylene, polyethylene terephalate, polyvinylchloride, a stiff metallic material, and paper.

15. The unitary liftable seal of claim 9, wherein said sealant is comprised of polypropylene, polyethylene ethylene vinyl acetate copolymer, polyester, or an adhearable material having a relatively low density and tensile strength.

16. The unitary liftable seal of claim 15, including an adhesive bonding said first layer to said sealant.

17. The unitary liftable seal of claim 9, including an intermediate layer between said first layer and said sealant.

18. The unitary liftable seal of claim 17, wherein said intermediate layer is aluminum foil.

19. The unitary liftable seal of claim 17, wherein said first layer is from about 0.010 to about 0.25 inches in thickness.

20. The unitary liftable seal of claim 17, wherein said intermediate layer is between about 0.001 inches 5 to about 0.010 inches in thickness.

21. The unitary liftable seal of claim 9, wherein said overhanging portion extends from about 0.005 inches to about 0.25 inches beyond said container.

22. An easy opening liftable seal for use with a container of the type having an opening defined by an upper rim comprising:

a liftable seal having a body portion and an overhanging portion that is maintained in substantially a singular horizontal plane over an upper rim of a container, said overhanging portion positioned about the periphery of said body portion and extends outwardly from said container upper rim, said liftable seal having a top planar surface and a bottom planar surface;

said body portion having a first layer, an intermediate layer, and a sealant layer, said first layer including a stiffening structure;

an upward force is applied to said bottom planar surface of said seal overhanging portion and an opposing downward force is applied to said top planar surface of said seal overhanging portion, wherein said liftable seal rigidity is responsive to said application of said upward force while said opposing downward force is substantially 0 N. to separate said liftable seal from said container rim and maintain said substantially singular horizontal plane.

23. The liftable seal of claim 22 wherein said upward force exerts a force of less than 14.7 N.

24. The liftable seal of claim 22, wherein said first layer is selected from the group consisting of PET, PP, Nylon, polyethylene (PE), polyvinylchloride (PVC), styrene, ethylene-vinylacetate (EVA), ethylene-vinyl-alcohol (EVOH), Vinyl, foams of the preceding 20 materials, paper, aluminum, steel, and combinations thereof.

25. The liftable seal of claim 22, wherein said sealant layer is comprised of polypropylene, ethylene vinyl acetate copolymer or an adhearable material having a relatively low density and tensile strength.

26. The liftable seal of claim 22, wherein said intermediate layer includes aluminum foil.

27. The liftable seal of claim 22, wherein said first layer is from about 0.010 inches to about 0.25 inches in thickness.

28. The liftable seal of claim 22, wherein said intermediate layer is from about 0.001 inches to about 0.010 inches in thickness.

29. The liftable seal of claim 22, wherein said overhanging portion extends from about 0.005 inches to about 0.25 inches beyond said upper rim of said container.

30. A unitary liftable seal for sealing a container comprising:

a generally disk shaped liftable seal in substantially a singular horizontal plane about and above an opening of a container neck, said liftable seal having a first layer and a sealant;

said sealant disposed so as to be adaptable for attachment of said first layer to said container neck about said opening therein;

an overhanging portion of said first layer extends beyond an outer surface of said container neck sufficient for engagement with a portion of the hand to apply a single force; and said first layer composed of a stiffening structure of such thickness and rigidity that said unitary liftable seal can be loosened with said single force applied to an underside surface of said overhanging portion of said first layer to separate said unitary liftable seal from said container neck while maintaining said substantially singular horizontal plane.

31. The unitary liftable seal of claim 30 wherein said single force is less than 14.7 N.

32. The unitary liftable seal of claim 31 wherein said single force is between about 8.8 N. and 10.8 N.

33. The unitary liftable seal of claim 30 wherein said overhanging portion of said first layer extends beyond said outer surface of said container neck more than 0.03 inches.

34. The unitary liftable seal of claim 30 wherein said overhanging portion of said first layer extends beyond said outer surface of said container neck in a range of 0.070 and 0.085 inches.

35. The unitary liftable seal of claim 30 wherein said peelable seal and a portion of said container neck have a closure surrounding an outer portion thereof and is removably engaged with said container neck.

36. The unitary liftable seal of claim 35 wherein said container neck has a helical thread depending from said outer surface thereof and said closure has a helical thread depending from an inner surface of an annular sidewall.

37. The unitary liftable seal of claim 36 wherein said closure has a retaining ring proximate a lower side of said overhanging portion of said peelable seal, said peelable seal having a first diameter larger than a distance between inner edges of said retaining ring thus being retained within said closure proximate a top wall thereof before said peelable seal is heat sealed to an upper rim of said container neck, said peelable seal having a second diameter smaller than said distance between inner edges of said retaining ring after said peelable seal is heat sealed to said upper rim of said container neck enabling said closure to be removed from said container neck without loosening said seal.

* * * * *